United States Patent [19]

Harrison et al.

[11] 4,375,403

[45] Mar. 1, 1983

[54] SOLVENT DEWAXING PROCESS

[75] Inventors: Charles W. Harrison, Houston; Herbert J. Pitman, Nederland; Avilino Sequeira, Jr., Port Arthur; John D. Begnaud, Kingwood, all of Tex.

[73] Assignee: Texaco Inc., White Plains, N.Y.

[21] Appl. No.: 340,436

[22] Filed: Jan. 18, 1982

[51] Int. Cl.[3] ..... C10G 21/00; C10G 21/02

[52] U.S. Cl. ..... 208/33

[58] Field of Search ..... 208/33

[56] References Cited

U.S. PATENT DOCUMENTS

| | | | |
|---|---|---|---|
| 2,668,141 | 2/1954 | Palmqvist | 208/33 |
| 2,698,279 | 12/1954 | Mordria | 208/33 |
| 3,350,297 | 10/1967 | Torobin | 208/33 |
| 3,429,800 | 2/1969 | Sparks | 208/33 |
| 3,796,651 | 3/1974 | Rojey | 208/33 X |
| 3,972,802 | 8/1976 | Bushnell | 208/33 |
| 4,115,242 | 9/1978 | Sequeira et al. | 208/33 |

*Primary Examiner*—Delbert E. Gantz
*Assistant Examiner*—G. Caldarola

[57] ABSTRACT

A process for dewaxing a petroleum oil stock with a liquid solvent employing direct heat exchange cooling of solvent-oil mixture with an immiscible liquid chilling medium.

12 Claims, 1 Drawing Figure

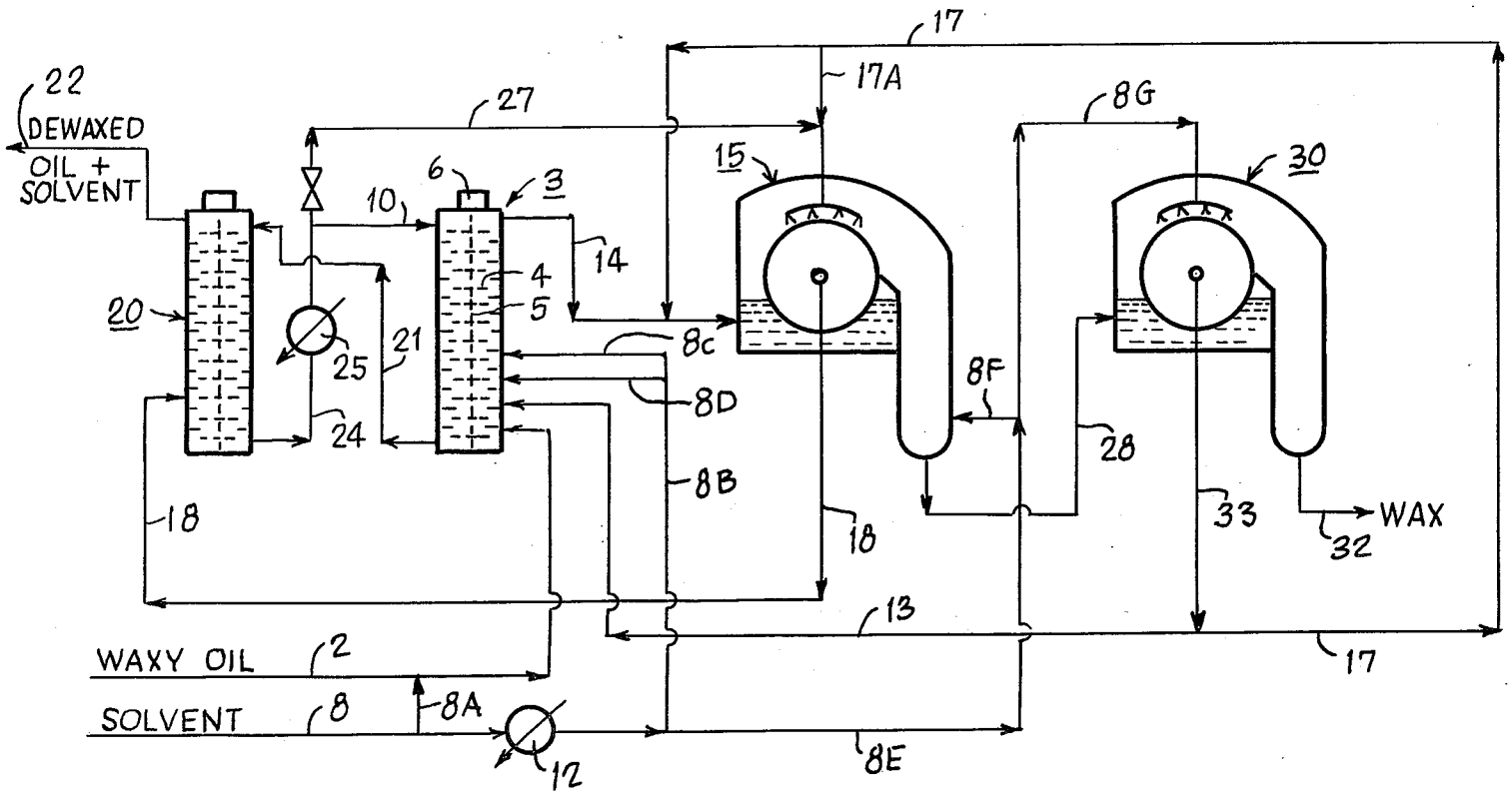
WAX
32
30
33
17
8G
28
8F
17
17A
13
8E
18
15
8c
8D
8B
14
3
4
5
27
6
12
8A
10
21
25
24
2
8
WAXY OIL
SOLVENT
18
20
22
DEWAXED OIL + SOLVENT

SOLVENT DEWAXING PROCESS

This invention relates to a process for dewaxing oils. In one of its more specific aspects, it relates to the dewaxing of waxy petroleum oils, particularly, petroleum lubricating oil stocks. The process of this invention results in the formation of wax crystals containing a relatively low oil content which may be readily filtered from the oil-solvent mixture. In the process of this invention, the oil-solvent mixture is cooled by direct heat exchange with an immiscible liquid heat exchange medium.

A number of methods are known for solvent dewaxing of petroleum oil stocks. In general, a waxy oil stock is mixed with a solvent for the oil and the resulting mixture slowly chilled to a temperature at which solid wax crystals form in the mixture. As the temperature is progressively lowered, the amount of wax precipitated from the oil-solvent mixture increases until the desired dewaxing temperature is reached. The wax may be then separated from the oil-solvent mixture by filtration and solvent recovered from the dewaxed oil for reuse in the process.

In most of the industrial processes for the separation of wax from petroleum oil stocks, dewaxing solvent is mixed with a waxy oil stock and the mixture cooled at a controlled rate in a scraped surface heat exchanger to the dewaxing temperature. Generally, the oil and a portion of the solvent are mixed with one another at a temperature effective for solution of the oil in the solvent. The oil and an initial amount of solvent are mixed with one another at a temperature above that at which wax crystals begin to form, i.e., above the cloud point of the oil feedstock. This mixture of oil and solvent is then cooled, usually with incremental addition of more solvent during cooling, at a uniformly slow rate under conditions which avoid vigorous agitation of the solution after the initial formation of wax crystals begins to take place, i.e. after the cloud point is reached, to permit the growth of relatively large, readily filtrable crystals of solid wax. Such prior art processes are illustrated in U.S. Pat. Nos. 3,764,517; 4,115,243; and 4,140,620, incorporated herein by reference.

Dewaxing solvents are employed to maintain fluidity of the oil in the coolers and chillers, and may be added before the oil is cooled and in increments during cooling. Often the oil is given a final dilution with solvent at the separation temperature, reducing its viscosity for rapid filtration. Commonly, solvent added to the oil in such processes is at the same temperature, or at a somewhat higher temperature, than the oil. Under controlled conditions, wax crystals are formed which are easily separated from the oil by filtration and which contain little occluded oil. In some processes, solvent is added to the oil at a temperature below the temperature of the oil to effect simultaneous chilling and dilution of the oil and oil-solvent mixtures in the system. U.S. Pat. No. 3,775,288 and related patents describe dewaxing processes in which cooling and dilution of lubricating oil stocks are accomplished simultaneously by incremental addition of cold solvent to the oil stock with intense agitation at each point of solvent injection. This process is known in the art as dilution chilling.

Chilling of oil-solvent mixtures by direct contact with an aqueous brine or aqueous solution of alcohols or ketones, including glycols and glycerols, is known from U.S. Pat. No. 3,796,651. In this and related prior art processes, wax is separated from the oil-water-solvent mixture by a flotation process, optionally supplemented by filtration.

In a typical commercial process, the waxy oil charge is diluted with solvent and heated, if necessary, to a temperature at which all the wax present in the charge is dissolved. The homogeneous charge is then passed to a cooling zone wherein cooling takes place at a uniformly slow rate in the range of about 0.5° to 5.5° C. per minute until the desired dewaxing temperature is reached. At the final dewaxing temperature, usually in the range of −15° to −20° C., a substantial portion of the wax is crystallized to yield after separation of solidified wax, a dewaxed oil of the desired pour point, generally in the range of about −25° C. to −40° C. Wax crystals are separated from the mixture of oil and solvent at the dewaxing temperature with recovery of a dewaxed oil-solvent solution and a solid wax containing a minor proportion of oil (slack wax). The separated oil-solvent solution is further processed for recovery of solvent and product dewaxed oil. The slack wax may be subjected to additional processing for recovery of occluded oil and production of a product wax.

The recovery of solvent from dewaxed oil and from wax-solvent mixtures produced in solvent dewaxing operations may be effected by distillation. A combination of high and low pressure flash vaporization stages followed by stripping with steam or inert gas is generally preferred. A system for separately recovering two solvents from a dewaxed oil-solvent solution and from a wax slurry by a combination of high and low pressure flash vaporization followed by gas stripping is disclosed in U.S. Pat. No. 4,052,294, incorporated herein by reference.

In commercial solvent dewaxing processes, separation of crystalline wax from dewaxed oil-solvent solutions is commonly accomplished in rotary drum vacuum filters. Rotary drum vacuum filters are common articles of commerce, and are well understood by those skilled in the art. Wax separated from the dewaxed oil-solvent mixture by filtration is referred to as slack wax, and the filtration step is referred to as primary filtration. Slack wax from a primary filter contains a quantity of dewaxed oil entrained and occluded in the wax crystals. In order to improve the recovery of dewaxed oil and at the same time improve the quality of the recovered wax, slack wax from the primary filter is often slurried with additional cold dewaxing solvent to dissolve the dewaxed oil contained in the wax. This slurry is filtered in a second filtration step to yield a wax cake of substantially reduced oil content and a solvent solution of dewaxed oil by means of a rotary filter, termed a repulp filter. A third stage, called wax deoiling, is sometimes used. In this case, a second wax-solvent slurry is subjected to a third filtration conducted at a somewhat higher temperature than the second filtration to remove essentially all the remaining oil as well as low melting point wax components from a relatively hard product wax.

In the process of the present invention, oil-solvent mixtures are cooled by direct heat exchange with an immiscible liquid heat exchange medium, preferably with agitation to insure intimate countercurrent contact between the oil-solvent mixture and the immiscible liquid heat exchange medium. The immiscible liquid may be any liquid which is substantially inert with respect to the solvent and oil stock undergoing treatment, which has a different specific gravity from the oil and solvent, and which remains in the liquid phase over the range of temperatures employed, usually in the range of −40° C. to +65° C. A preferred immiscible liquid heat exchange medium comprises a mixture of ethylene glycol and water; a mixture of substantially equal parts by volume of ethylene glycol and water is suitable and generally preferred. Other heat exchange liquid media may be employed in the process as well as other mixtures of glycols and water.

The process of this invention is generally applicable to various solvent dewaxing systems, such as propane dewaxing or well known solvent dewaxing operations employing as dewaxing solvent a mixture of a mineral oil solvent, such as an aromatic hydrocarbon, e.g. benzene, toluene and the like, and a wax anti-solvent, such as a normally liquid aliphatic ketone containing from three to nine carbon atoms per molecule, e.g. acetone, methylethylketone, methylisobutylketone, methyl-n-propylketone, and the like. Usually the preferred aliphatic ketone is methylethylketone or methylisobutylketone and the preferred aromatic hydrocarbon is toluene. The process is applicable to other solvent systems, for example dichloromethane, dichloroethane, mixtures of dichloroethane and dichloromethane, mixtures of acetone and toluene, mixtures of acetone and benzene, and mixtures of acetone, benzene and toluene. Such solvent systems are well known in the art.

In the practice of this invention, the feed material undergoing dewaxing is preferably subjected to agitation or stirring during cooling through the initial temperature range from above its cloud point to a temperature below the cloud point and preferably to the final dewaxing temperature. "Cloud point" may be defined as that temperature at which crystals of precipitated solid waxy material first begin to appear in the oil-solvent mixture as indicated by visual observation of a haze. The cloud point is usually determined in a laboratory under standard ASTM test conditions.

The petroleum oil base stock undergoing treatment in the dewaxing operation described herein may be diluted with solvent prior to and/or during the cooling operation. It will be understood that the cloud point of a mixture of oil and solvent, in the case where the oil base stock is prediluted with a portion of the solvent, will be lower than the cloud point for undiluted base stock. This lowered cloud point is sometimes referred to as the depressed cloud point of the oil. The cloud point for any particular dilution or mixture of solvent and base stock may be determined in the laboratory and these results translated to plant operation. Predilution of the base stock is generally desirable when high viscosity base stocks are treated. In such cases, sufficient solvent is added to the base stock prior to or during the initial chilling to maintain allowable viscosities and associated pressure drops within the equipment and to permit ready separation of the oil-solvent mixture from the immiscible heat exchange liquid.

Details of the invention will be evident from the accompanying drawing and the following detailed description of the process of this invention.

The FIGURE is a simplified schematic flow diagram illustrating a preferred embodiment of the process of this invention.

With reference to the drawing, a waxy petroleum distillate is introduced through line 2 to a chilling zone 3 where it is cooled to dewaxing temperature. In the embodiment illustrated in the FIGURE, chilling zone 3 comprises a vertical liquid-liquid countercurrent contacting tower with the oil feedstream entering the lower portion of the tower. Tower 3 comprises a countercurrent contactor suitably a turbine type mixer, rotary disc contactor or disk and donut type contactor of known type. In the contactor illustrated, discs, paddles or blades 4 are mounted on a vertical shaft 5 rotated by a suitable motor 6. Solvent for predilution of the oil, if desired, may be introduced into admixture with the oil in line 2 from a solvent supply line 8 through line 8A in a controlled amount sufficient to provide the desired predilution of the waxy oil feedstock prior to introduction to heat exchanger tower 3.

A cold heat exchange liquid, e.g. an aqueous salt solution or a mixture of ethylene glycol and water, is introduced into the upper part of tower 3 through line 10. As the oil-solvent mixture introduced into the lower part of the tower 3 through line 2 passes upwardly through the tower, it is intimately countercurrently contacted with the cold heat exchange liquid from line 10. The rotating disc contactor or tubine mixer illustrated provides a number of stages of mixing of the waxy oil-solvent mixture with the heat exchange liquid interspersed with separation of the heat exchange liquid and the oil-solvent mixture. Thus a number of contacts between the oil-solvent mixture flowing up the column and the heat exchange liquid flowing down the column take place in tower 3.

Additional amounts of solvent, prechilled in heat exchanger 12 by a suitable refrigerant, may be introduced into tower 3 at various points via lines 8B, 8C and 8D. Cold filtrate from a rotary drum vacuum filter, as described later, is also introduced into tower 3 through line 13. In passing upwardly through tower 3, the oil-solvent mixture is progressively chilled to dewaxing temperature by direct contact with heat exchange medium from line 10.

Chilled oil-solvent mixture containing wax crystals formed in the mixture during the chilling process is discharged from the upper portion of tower 3 through line 14 to rotary drum filter 15. Additional solvent from line 17 may be added to the chilled oil-solvent mixture in line 14. Solvent from line 17 may comprise cold filtrate from a rotary drum vacuum filter as later described. The mixture from line 14 comprising dewaxing solvent, dewaxed oil and entrained precipitated waxed crystals, is passed to filter 15, preferably a rotary drum type vacuum filter, wherein the mixture of oil and dewaxing solvent is drawn to the filter and solid wax is retained on the filter.

Filtrate, comprising a mixture of dewaxed oil and dewaxing solvent is drawn from filter 15 through line 18 to the lower portion of a second heat exchange tower 20 wherein it is brought into intimate countercurrent liquid-liquid contact with warmed heat exchange liquid drawn from the bottom of chiller 3 through line 21 and introduced into the upper part of countercurrent heat exchange tower 20. As the cold mixture of dewaxed oil and solvent from line 18 passes upwardly through heat exchange tower 20 the oil-solvent mixture is warmed to a temperature closely approaching the temperature of waxy oil and solvent from lines 2 and 8 while the heat exchange liquid is cooled to a temperature approaching the dewaxing temperature, i.e. the temperature of filtrate from line 18. Dewaxed oil and solvent are discharged from heat exchange tower 20 through line 22 to a suitable solvent recovery system, not illustrated. Heat exchange tower 20 may be a contactor of essentially the same construction as heat exchange tower 3, already described. Cold immiscible heat exchange liquid, chilled to a temperature near dewaxing temperature in heat exchange tower 20, is withdrawn from the lower part of tower 20 through line 24 and cooled to or slightly below dewaxing temperature in heat exchanger 25 by refrigerant from a suitable source, not illustrated, before recycle to heat exchanger 3.

Wax separated from the dewaxed oil and solvent in filter 15 forms a wax cake on the surface of the filter which is wahsed on the filter with cold filtrate from filter 30 via lines 17 and 17A or with heat exchange liquid from cooler 25 via line 27. The washed wax cake is continuously removed from the filter, and mixed with cold fresh solvent from line 8 and cooler 12, via lines 8E and 8F to form a slurry of wax in solvent. The wax-solvent slurry is passed through line 28 to repulping filter 30 wherein oil retained in the wax cake from filter 15 is recovered from the wax. The wax cake is washed on the filter with cold solvent from line 8 and cooler 12 via lines 8E and 8G. Deoiled wax cake is continuously removed from the filter 30 and discharged through line 32 to the recovery section from where it will emerge as a wax product.

Filtrate from filter 30 is withdrawn through line 33 and split into two streams, one of which is passed through line 17 and supplies cold diluent to the chilled oil-solvent stream from line 14, and the other, passed through line 13 to tower 3 as diluent for the oil-solvent mixture undergoing chilling in tower 3.

We claim:

1. In a process for dewaxing a waxy lubricating oil stock by cooling said stock in the presence of a dewaxing solvent to a temperature effective for the removal of wax therefrom by filtration the improvement which comprises introducing said oil stock into a chilling zone into countercurrent liquid-liquid contact with a chilled immiscible heat exchange liquid, separating said heat exchange liquid from resulting chilled oil stock, introducing dewaxing solvent into admixture with said chilled oil stock at substantially dewaxing temperature, separating by filtration solidified wax from resulting dewaxed oil and solvent, recovering a mixture of solvent and oil of diminished wax content from said filtration step, and passing said dewaxed oil/solvent mixture at substantially said dewaxing temperature into intimate countercurrent liquid-liquid contact with immiscible liquid coolant from said cooling zone thereby chilling said heat exchange liquid for reuse in said cooling zone and warming said mixture of dewaxed oil and solvent, separating said warmed dewaxed oil and solvent from said heat exchange liquid, chilling said heat exchange liquid to substantially dewaxing temperature and reintroducing said chilled heat exchange liquid into said cooling zone.

2. The process of claim 1 wherein wax separated from said dewaxed oil and solvent is washed at said dewaxing temperature with immiscible heat exchange liquid and recovered from said filtration step with said dewaxed oil and solvent.

3. A process according to claim 1 wherein said immiscible liquid heat exchange medium is a mixture of ethylene glycol and water.

4. A process according to claim 1 wherein the dewaxing solvent is a mixture of a dialkyl ketone and toluene.

5. A process according to claim 1 wherein the dewaxing solvent is a mixture comprising methylethylketone and methylisobutylketone.

6. The process of claim 1 wherein the dewaxing solvent is selected from the group consisting of a mixture of (1) methylethylketone and methylisobutylketone, (2) methylethylketone and toluene, (3) methylisobutylketone and toluene, (4) acetone and toluene, (5) propylene and acetone, (6) acetone, benzene and/or toluene, (7) dichloroethane and dichloromethane, (8) methylisobutylketone alone, and (9) methylisobutylketone/acetone.

7. The process of claim 1 wherein the solvent-waxy oil mixture in said chilling zone is cooled at a rate of less than 6° F. per minute.

8. A process according to claim 1 wherein said first chilling zone comprises a plurality of stages with said waxy oil passing from stage to stage of said chilling zone and said immiscible liquid passing from stage to stage in said chilling zone countercurrent to the direction of progression of said oil, maintaining a high degree of agitation and mixing of said immiscible liquid and waxy oil in at least a portion of said stages, thereby effecting intimate contact between said oil and said liquid chilling medium with cooling of said oil as it progresses through said chilling zone to the temperature at which wax is separated from dewaxed oil and solvent with progressive warming of said immiscible liquid as it progresses through said chilling zone.

9. A process according to claim 1 wherein said immiscible liquid is contacted with said oil-solvent mixture in said chilling zone in relative proportions in the range of 0.4 to 2 volumes of said immiscible liquid per volume of said oil-solvent mixture.

10. A process according to claim 9 wherein said first filter cake containing wax crystals and occluded oil-solvent mixture is washed at dewaxing temperature with said immiscible liquid thereby separating dewaxed oil from said filter cake, and said filtrate comprises dewaxed oil, solvent and said immiscible liquid.

11. The method of separating wax from a wax-bearing oil which comprises:

(a) mixing said wax-bearing oil with a dewaxing solvent, (b) passing the resulting oil-solvent mixture in a first cooling zone into direct countercurrent contact with an immiscible liquid chilling medium effecting warming of said immiscible liquid chilling medium and concomitant cooling of said oil-solvent mixture to a temperature at which wax crystallizes forming a slurry of wax in oil-solvent mixture, (c) separating said slurry from said immiscible liquid, (d) filtering said slurry thereby forming a first filter cake of slack wax containing wax crystals and occluded oil-solvent mixture and a filtrate comprising dewaxed oil and solvent, (e) passing said filtrate into direct heat exchange with warmed immiscible liquid from step (b) effecting cooling of said immiscible liquid and warming of said filtrate, (f) recovering cooled immiscible liquid from said filtrate, (g) further cooling said immiscible liquid from step (f), and (h) passing said cooled immiscible liquid from step (g) into direct heat exchange with said oil-solvent mixture in said first cooling zone as the source of immiscible liquid therefor.

12. A process according to claim 2 in which the volume of immiscible liquid employed as wash for said filter cake is in the range of 0.4 to 2 volumes per volume of waxy oil feedstock.

* * * * *